US006096167A

United States Patent [19]

Reiner et al.

[11] Patent Number: 6,096,167

[45] Date of Patent: Aug. 1, 2000

[54] PROCESS OF MANUFACTURING A COLORED FIBER MATERIAL

[75] Inventors: Lennart Reiner, Matfors; Ulf Holm, Göteborg, both of Sweden

[73] Assignee: SCA Hygiene Paper AB, Gothenburg, Sweden

[21] Appl. No.: 08/849,522

[22] PCT Filed: Dec. 20, 1995

[86] PCT No.: PCT/SE95/01549

§ 371 Date: Jun. 11, 1997

§ 102(e) Date: Jun. 11, 1997

[87] PCT Pub. No.: WO96/20310

PCT Pub. Date: Jul. 4, 1996

[30] Foreign Application Priority Data

Dec. 27, 1994 [SE] Sweden ..... 9404511

[51] Int. Cl.[7] ..... D21B 1/08

[52] U.S. Cl. ..... 162/4; 162/191

[58] Field of Search ..... 162/4, 134, 141, 162/13, 162, 147, 191; 427/381; 428/921; 502/402

[56] References Cited

U.S. PATENT DOCUMENTS

| | | | |
|---|---|---|---|
| 2,905,583 | 9/1959 | Feigley, Jr. et al. | 162/134 |
| 3,377,235 | 4/1968 | Webster | 162/6 |
| 3,660,226 | 5/1972 | McKeown | 162/264 |
| 4,202,852 | 5/1980 | Pauls et al. | 162/141 |
| 4,243,480 | 1/1981 | Hernandez et al. | 162/141 |

FOREIGN PATENT DOCUMENTS

| | | |
|---|---|---|
| 369 428 | 8/1974 | Sweden . |
| 1 407 060 | 9/1975 | United Kingdom . |

*Primary Examiner*—Dean T. Nguyen
*Attorney, Agent, or Firm*—Burns, Doane, Swecker & Mathis, L.L.P.

[57] ABSTRACT

Process for the manufacture of a colored fibre material, containing a certain proportion of cellulose fibres, such as paper and nonwoven. A dyestuff is applied onto reel or sheet pulp either on the whole material or only on part of it, whereupon the reel or sheet pulp is defibrated and dispersed in liquid or foam possibly together with other fibres. The fibre dispersion is thereafter applied onto a wire and dewatered, whereupon the formed fibre web, which contains a substantially even addition of colored fibres, is subjected to possible further treatment steps before drying and reeling. A fibre material manufactured according to the process is also disclosed. If only part of the pulp fibres are colored, a mottled color impression of the material is obtained.

16 Claims, No Drawings

PROCESS OF MANUFACTURING A COLORED FIBER MATERIAL

TECHNICAL AREA

The present invention relates to a process of manufacture for a coloured fibre material, containing a certain proportion of cellulose fibres, such as paper or nonwoven, wherein a dyestuff is applied onto reel or sheet pulp either on the whole material or only on part of it. The invention further relates to a coloured fibre material manufactured according to the process.

BACKGROUND OF THE INVENTION

Nowadays paper is as a rule coloured with cationic direct dyes, which are water insoluble dyestuffs with strong affinity to cellulose fibres. The dyestuff is generally added to the fibre dispersion, i.e. the fiber dispersion in water which is applied onto the wire, but it can also be applied onto the completely formed paper sheet by means of various application methods. These colouring methods have in common that they give a dyeing of all pulp fibres containing reactive groups whereby a comparatively evenly coloured paper sheet is obtained. In manufacture of paper based on recycled fibres it occurs that coloured paper is reused and thereby a recycled paper pulp is obtained with an element of coloured fibres giving a paper with a mottled colour.

Coloured nonwoven materials can be manufactured in different ways, e.g. by addition of a certain proportion of coloured synthetic fibres. This is however comparatively expensive because of the high price involved with coloured fibres. A cheaper way of colouring nonwoven material is to apply dyestuff by means of some form of finishing treatment such as Foulard treatment or by printing of dyestuff possibly together with a binder. Both Foulard treatment and printing make great demands on accurate dyestuff dosing systems if a result pleasing to the eye is to be obtained.

In certain types of soft tissue paper, e.g. napkins and nonwoven material, a mottled colouring may be preferable because of aesthetic reasons, since a mottled colouring is associated with textile rather than paper.

It is known from U.S. Pat. No. 4,202,852 to manufacture a coloured drylaid nonwoven material by applying dyestuff onto reel or sheet pulp, which is thereafter dried to a moisture content of less than 15% and defibrated in a hammer mill. The fibres are airlaid onto a wire, whereupon a binder is added to the airlaid fibre web. After curing of the binder an evenly coloured drylaid fibre material is obtained.

OBJECT OF THE INVENTION AND MOST IMPORTANT FEATURES

The object of the present invention is to achieve a simple process for colouring of wetlaid or foamformed fibre materials, such as paper and nonwoven. The process should allow both a complete colouring of the material as well as a mottled colouring. According to the invention this has been achieved by applying a dyestuff onto reel or sheet pulp either on the whole material or only on part of it, whereupon the reel or sheet pulp is dispersed in a liquid or foam possibly together with other fibres, and that the fibre dispersion is applied onto a wire and dewatered, whereupon the formed fibre web, which contains a substantially even addition of coloured fibres, is subjected to possible further treatment steps before drying and reeling.

DESCRIPTION OF THE INVENTION

Either all reel or sheet pulp is dyed or only part of it. In partial dyeing the dyestuff is suitably continously applied in a streak along the reel pulp, whereby the width of the streak determines how large a portion of the pulp is coloured and the dyestuff concentration determines the colour strength of the coloured pulp fibres. In partial dyeing between 1 and 50% of the pulp fibres are suitably coloured. A multi-coloured material can also be obtained by applying several different colours in different streaks, which for example enables the manufacture of material which at a distance appears to be green but which in reality contains both yellow and green pulp fibres.

The dyestuff used should have strong affinity to cellulose so as to fix it to the pulp fibres without spreading or bleeding out to the water or foam when defibrating the pulp. Conventional cationic direct dyes which are used for normal colouring of paper function exellently for this purpose. Also other dyestuffs bound to the pulp fibres with a binder may be used. The dyestuff is applied onto the reel or sheet pulp by spraying, coating, Foulard treatment or printing.

Other fibres such as synthetic fibres, vegetable fibres, regenerated cellulosic fibres and/or pulp fibres, e.g. originating from bale pulp, may be mixed with the reel pulp fibres in the dispersing vessel.

The fibre dispersion is formed and thereafter applied onto a wire for dewatering. After the dewatering, the coloured fibre web may be subjected to possible further treatment before drying and reeling, e.g. creping for manufacture of soft tissue paper, embossing, addition of various chemical additives such as softening agents, binders or wet strength agents. Before or after drying, the fibre web may also undergo hydroentanglement or other bonding technique for manufacture of a nonwoven material.

Fibre webs with different colour may also be laminated together into an unequal-sided coloured material.

The invention will be described in the following in greater detail by way of several embodiments, which are however by no means limiting for the invention.

EXAMPLE 1

In this trial a minor portion of the width of a continously running reel pulp web was coloured before it was disintegrated and dispersed in a pulper containing foam, i.e. a mixture of water, surfactant and air. The reel pulp was composed of bleached sulphate pulp (ECF) without any addition of debonder. The basis weight of the pulp was 750 g/m$^2$ and the web speed was 0.5 m/min.

A conventional cationic paper dyestuff from Sandoz was used, Cartasol Türkis KGL FL, diluted to 10% dye solution calculated on the commodity. The dosing was performed with the aid of a membrane pump pumping dye solution to a nozzle located approx. 5 mm above the running pulp web which had a web width of 254 mm.

At a flow of 11.25 ml/min dye solution a dye streak was obtained, on average corresponding to 12% of the width of the pulp web and 0.3 weight- % calculated on the total pulp amount. Calculated on the 12% of the pulp web which was dyed this means 2.5 weight- % dyestuff (commodity).

After the dyeing, pulp was coarsely disintegrated and dispersed in foam in said pulper. Thereafter a papersheet consisting of approx. 88% white pulp fibres and 12% strongly coloured pulp fibers was foamformed. The foam-forming was done according to the technique descriped in Swedish Patent Application 9402469-2.

After pressing and heated air drying with conventional techniques, a paper sheet was obtained having an even, clearly mottled structure—turquoise pulp fibres against white background.

EXAMPLE 2

Also in this trial a minor portion of the web width, of a continously running reel pulp web, was dyed before dispersion in foam in a pulper as above. The reel pulp was composed of bleached sulphate pulp (ECF) without any addition of debonder. The basis weight was 750 g/m$^2$ and the web speed was 0.5 m/min.

In this case another cationic paper dyestuff from Sandoz, Cartasol Blau KRL 80% F, was used diluted to a 30% dye solution calculated on the commodity. The dosing was done with the aid of a membrane pump pumping dye solution to a nozzle located approx. 5 mm above the running pulp web, which had a web width of 254 mm.

At a flow of 3.75 ml/min dye solution a dye streak was obtained, on average corresponding to 5% of the total pulp web width and 0.3 weight- % dyestuff calculated on the total pulp amount. Calculated on the 5% of the pulp which was dyed, this meant 6 weight- % dyestuff (commodity).

After the dyeing, the pulp was coarsely disintegrated and dispersed in foam in said pulper. In this case, a commercially available polypropylene fibre (1.7 dtex×18 mm), was also simultaneously added into the pulper. The mixing ratio between the fibres was 60% pulp fibres and 40% polypropylene fibres. Calculated on the total amount of fibres (pulp+polypropylene), 0.18 weight- % dyestuff was added.

Thereafter, a paper sheet, consisting of approx. 57% white pulp fibres, approx. 3% strongly coloured pulp fibres and 40% polypropylene fibres, was foamformed. The foamforming was done according to techniques described in Swedish Patent Application 9402469-2.

The foamformed sheet was subsequently hydroentangled with conventional entanglement techniques with an energy input corresponding to 600 kWh/ton, see for example Swedish Patent Application 9402470-0. After pressing and heated air drying, a hydroentangled nonwoven material was obtained with an even, weakly mottled structure—blue pulp fibres on white background.

The invention is of course not limited to the above described embodiments but may be varied within the scope of the following claims.

What is claimed is:

1. A process for the manufacture of colored fiber material containing a proportion of cellulose fibers, comprising the steps of:

applying a dyestuff onto a reel or sheet of pulp containing cellulosic fibers so as to bond the dyestuff to the cellulose fibers;

dispersing the reel or sheet of pulp in liquid or foam to form a dispersed fibers;

depositing dispersed fibers onto a wire and dewatering the fibers to form a fiber web; and drying and reeling the fiber web.

2. The process according to claim 1, wherein the dyestuff is applied onto the reel or sheet in a streak, the width of which is smaller than the width of the reel or sheet pulp.

3. The process according to claim 2, wherein dyestuffs of different colours are applied onto the reel or sheet in different streaks.

4. The process according to claim 1, wherein the dyestuff is applied onto the reel or sheet by means of spraying, coating, or printing.

5. The process according to claim 1, wherein the dyestuff shows strong affinity to cellulose fibers.

6. The process according to claim 5, wherein the dyestuff is a cationic direct dyestuff.

7. The process according to claim 1, wherein the dyestuff is bound to the fibers by means of a binder.

8. The process according to claim 1, wherein the reel or sheet after dyeing is mixed and dispersed together with other fibers from the group consisting of synthetic fibers, vegetable fibers, regenerated cellulosic fibres and fibers.

9. The process according to claim 1, wherein the formed fibers web is creped for the manufacture of a tissue paper.

10. The process according to claim 1, wherein the formed fibers web is subjected to hydroentanglement before or after drying.

11. The process according to claim 1, wherein fibers webs having different colour are laminated together into an unequal-sided coloured material.

12. The process according to claim 1, wherein a binder or wet strength agent is added to the fibers web by means of spraying, impregnation, or coating.

13. The process according to claim 1, wherein the dispersing step takes place after the dyestuff has bonded to the cellulose fibers.

14. The process according to claim 1, wherein other fibers are included in the dispersing step.

15. The process according to claim 1, wherein the dyestuff is applied to only a portion of the reel or sheet.

16. The process according to claim 1, wherein the dyestuff is applied to all portion of the reel or sheet.

* * * * *